US011597485B2

(12) United States Patent
Van Valkenburgh et al.

(10) Patent No.: US 11,597,485 B2
(45) Date of Patent: Mar. 7, 2023

(54) RETRACTABLE CONTROL FINS FOR UNDERWATER VEHICLES

(71) Applicant: BAE Systems Information and Electronic Systems Integration Inc., Nashua, NH (US)

(72) Inventors: Christopher G. Van Valkenburgh, Manchester, NH (US); Richard N. Jorgenson, Amherst, NH (US); Gary M. Shapiro, Wakefield, MA (US); Jerrod S. Allen, Austin, TX (US)

(73) Assignees: BAE Systems Information and Electronic, Nashua, NH (US); Systems Integration Inc., Nashua, NH (US)

( * ) Notice: Subject to any disclaimer, the term of this patent is extended or adjusted under 35 U.S.C. 154(b) by 143 days.

(21) Appl. No.: 17/108,552

(22) Filed: Dec. 1, 2020

(65) Prior Publication Data

US 2022/0169350 A1 Jun. 2, 2022

(51) Int. Cl.
*B63G 8/00* (2006.01)
*B63G 8/04* (2006.01)

(52) U.S. Cl.
CPC ..... *B63G 8/001* (2013.01); *B63G 8/04* (2013.01); *B63G 2008/002* (2013.01)

(58) Field of Classification Search
CPC .... B63G 8/001; B63G 8/04; B63G 2008/002; B63G 8/08; B63G 2008/004; B63G 2008/008; B63G 8/16; B63H 1/14; B63H 21/12; B63H 5/125; B63H 21/17; F42B 19/01; F42B 19/12
See application file for complete search history.

(56) References Cited

U.S. PATENT DOCUMENTS

| | | | | |
|---|---|---|---|---|
| 5,235,930 | A | 8/1993 | Pendleton | |
| 5,551,363 | A | 9/1996 | Cipolla et al. | |
| 5,582,364 | A * | 12/1996 | Trulin | F42B 10/14 244/3.29 |
| 5,615,632 | A * | 4/1997 | Nedderman, Jr. | F42B 10/14 114/330 |
| 6,352,218 | B1 | 3/2002 | Holmqvist et al. | |
| 6,672,537 | B1 | 1/2004 | Deckard et al. | |
| 10,773,780 | B2 | 9/2020 | Smith et al. | |

(Continued)

OTHER PUBLICATIONS

International Search Report, PCT/US21/61179, dated Mar. 28, 2022, 10 pages.

*Primary Examiner* — Anthony D Wiest
(74) *Attorney, Agent, or Firm* — Finch & Maloney PLLC; Gary McFaline

(57) ABSTRACT

Techniques are disclosed for providing retractable control fins on an underwater vehicle. The retractable control fins can be extended away from a main hull portion of the underwater vehicle and retracted inwards to a stowage region within the hull portion to protect the fins from damage and reduce an overall outer diameter (e.g., in the case of a cylindrical body) of the underwater vehicle. In some embodiments, the control fins are folded inwards to reduce the vehicle diameter. In other embodiments, the control fins are pulled inwards using a rotating structure designed to slide the control fins through an opening and into an inner portion of the hull to reduce the vehicle diameter. The retraction of the fins through the various retraction mechanisms reduces the envelope diameter of the underwater vehicle.

9 Claims, 12 Drawing Sheets

(56) References Cited

U.S. PATENT DOCUMENTS

| | | | |
|---|---|---|---|
| 2005/0145750 | A1 | 7/2005 | Okada et al. |
| 2013/0048787 | A1 | 2/2013 | Riley et al. |
| 2017/0369137 | A1 | 6/2017 | Smith et al. |
| 2019/0031309 | A1 | 1/2019 | Hoover |

* cited by examiner

RETRACTABLE CONTROL FINS FOR UNDERWATER VEHICLES

BACKGROUND

Unmanned underwater vehicles (UUVs) often navigate with the use of control surfaces or control fins, which extend outward from the vehicle body and may articulate to control movement. For a UUV to navigate tight enclosures while in transit or being launched, the full extent of the vehicle and control surfaces/fins impact whether a UUV can egress or ingress. For example, a submarine torpedo tube launch and recovery (TTLR) of a given UUV requires that vehicle to fit into cylindrical tube sections of a given diameter and length. This presents a problem for medium diameter vehicles (e.g., 12 to 21 inches in diameter) as it constrains both the height which control surfaces/fins can protrude from the vehicle (measured from the outside diameter of the UUV radially outward) as well as the vehicle length (measured from the furthest extents of UUV structure forward and aft). Accounting for the constraints on both control surfaces/fins and vehicle length, presents an arrangement challenge of the UUV internal volume and equipment that may limit the internal configuration of the UUV. Accordingly, complex and non-trivial issues associated with efficient UUV design remain.

Figure 1:
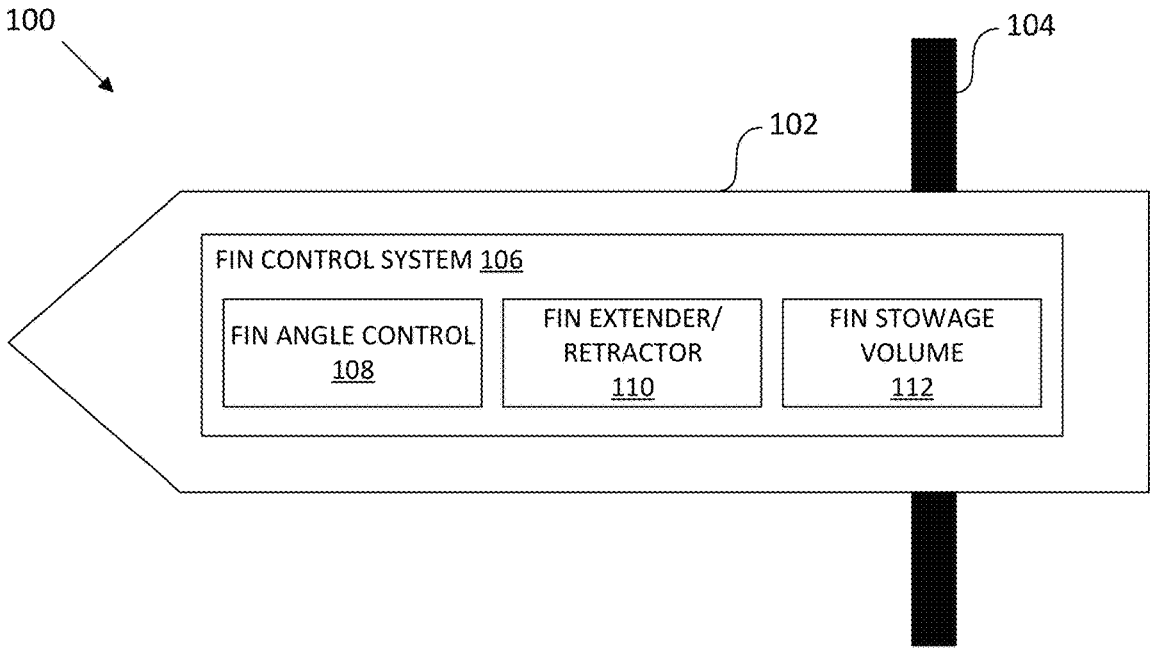
FIG. 1 illustrates an example of an underwater vehicle, in accordance with some embodiments of the present disclosure.

Although the following Detailed Description will proceed with reference being made to illustrative embodiments, many alternatives, modifications, and variations thereof will be apparent in light of this disclosure.

DETAILED DESCRIPTION

Techniques are disclosed for providing retractable control fins on an underwater vehicle. The retractable control fins can be extended away from a main hull portion of the underwater vehicle and retracted inwards towards or within a stowage region of the hull portion to protect the fins from damage and reduce an overall outer diameter (e.g., in the case of a cylindrical body) of the underwater vehicle. In some embodiments, the control fins are folded inwards to reduce the vehicle diameter. In other embodiments, the control fins are pulled inwards using a rotating structure designed to slide the control fins through an opening and into an inner portion of the hull. The retraction of the fins through the various retracting mechanisms reduces the envelope diameter of the underwater vehicle, allowing the underwater vehicle to fit within confined spaces, such as a torpedo tube.

Most underwater vehicles utilize fin structures (generally, any control surface) that extend from the underwater vehicle and assist in steering and control of the vehicle through the water. Such structures typically only allow minor movements such as tilting or pitching to control movement of the vehicle. Completely retracting such structures so that they do not extend beyond the outer diameter (OD) of the underwater vehicle is complicated for several reasons. First, the underwater environment creates sealing considerations, a retraction of structure into the vehicle body may create a risk for water to leak into sealed or dry portions of the vehicle. Second, designing mechanical structures to extend and retract fins may take up precious payload space within the underwater vehicle and potentially reduce the volume available for placing electronics or other payloads. Accordingly, designing a retractable control system for these fin structures that minimizes the impact on the overall vehicle volume is no trivial task.

In one example system, a retractable fin control system is used on an underwater vehicle having a cylindrical hull structure with hinged fins that fold about a servo module when positioned or otherwise stowed normal to the OD of the vehicle. Once folded, the hull is designed such that the fins are positioned and angled to reside external to the hull but below the OD of the vehicle, through the actuation of a one or more servo motors in the servo module, according to an embodiment. Within the hull, additional servo motors are used to control angles of the fully extended or otherwise deployed fins. Aside from the corresponding internal servo motors, a cylindrical dry volume, internal to the vehicle, is allowed for by this mechanism as the retraction mechanism occupies a volume just beneath the OD of the vehicle. A cylindrical trough/trench (e.g., spool shape) is used around a circumference of the hull, interrupting a continuously faired shape of the vehicle, to provide a region within which to collapse/fold the fins below the OD of the vehicle.

In another example system, a hull structure with a rotational carriage assembly is used to simultaneously retract all fins tangentially inward from the base when positioned normal to the OD of the vehicle. Once retracted, the fins are positioned and angled to reside below the OD of the vehicle through the rotation of mechanical linkages, motor, and/or carriage structure, according to an embodiment. A single servo motor at the base of each fin is used to control the angle of the fully extended fin. An unobstructed cylindrical volume, internal to the vehicle, would be allowed for by this mechanism as the retraction mechanism occupies an annular volume surrounding the internal unobstructed volume within the vehicle. A cylindrically faired shape of the vehicle may be preserved, in general, as the retraction mechanisms would rotate below the OD of the vehicle.

These example retraction and folding mechanisms allow for fin heights on an underwater vehicle to extend beyond the diameters allowed by a confined launch tube, enabling a control system to assert more control authority per fin. Additionally, the retractable/extendable fin chord length to height (area) can be maximized, as fins extend uniformly outward from the vehicle. Furthermore, the example retraction and folding mechanisms may be used during normal transit of the underwater vehicle to navigate through tight openings, improve turning control authority, or reduce/increase drag. According to some embodiments, the example retraction and folding systems assert control without the need for complex mechanisms. According to some embodiments, the folding system uses a servo module at discrete locations along the outside of the hull. In some embodiments, these servo modules are each an assembly of two servo motors, one to extend/retract the fins and a second to control the fin angle. This packaging can be implemented to preserve the actuation control logic associated with existing methods and improves upon it with an additional set of servos. In some embodiments, the rotational retraction system can use a single motor to simultaneously extend/retract the array of fins. Furthermore, using a single servo motor at the base of each fin can preserve actuation control logic associated with existing methods.

In accordance with some embodiments, a retractable fin control system includes a housing section, a fin, and a controllable fin device. The housing section includes a first flange connected to a second flange by a cylindrical wall, the first flange and the second flange each having a larger diameter than the wall, such that an annular region exists around an outer surface of the wall and between the first and second flanges. An inner surface of the wall defines an inner volume. The controllable fin device includes a first actuator coupled to the fin, and a second actuator. The first actuator is coupled to the outer surface of the wall within the annular stowage region. The first actuator is configured to rotate the fin between a first (stowed) position within the annular region and a second position (deployed) extending radially outward from the wall. The second actuator is disposed within the inner volume and is designed to control a tilt angle of the fin.

In accordance with some other embodiments, a retractable fin control system includes a first cylindrical housing having a first diameter, a second cylindrical housing having a second diameter smaller than the first diameter, a fin coupled to the second cylindrical housing, and a fin control device. The second cylindrical housing is disposed within the first cylindrical housing and is designed to rotate within the first cylindrical housing. An inner surface of the second cylindrical housing defines an inner volume. The fin control device includes a first actuator coupled to the second cylindrical housing, and a second actuator coupled to the fin. The first actuator is designed to rotate the second cylindrical housing. The fin is designed to extend radially outward from the first and second cylindrical housings at a first position and to retract inwards into the inner volume at a second position. The fin is coupled to the second cylindrical housing such that rotation of the second cylindrical housing causes the fin to move between the first position and the second position. The second actuator is designed to control a tilt angle of the fin.

Numerous embodiments, variations, and applications will be appreciated in light of the disclosure herein.

FIG. 1 illustrates an example underwater vehicle 100. Underwater vehicle 100 may be any kind of submerged vehicle or platform, such as an unmanned underwater vehicle (UUV), although manned underwater vehicles can equally benefit as well. Underwater vehicle 100 is generally described herein as having a cylindrical shape (e.g., with a circular cross-section), such that underwater vehicle 100 fits within a torpedo tube prior to launch. However, underwater vehicle 100 may have any structural design that can benefit from having retractable fins (which herein is intended to refer to any retractable control surfaces).

Underwater vehicle 100 includes a hull 102. Any portion of hull 102 may be referred to herein as a housing as it surrounds some inner volume of underwater vehicle 100, according to some embodiments. Hull 102 may be any sufficiently rigid and strong material such as aluminum or steel and may be composed of several joined segments, according to some embodiments. Hull 102 may have a cylindrical shape to provide better control when moving through water. According to some embodiments, hull 102 may have an outer diameter (OD) between about 10 inches and about 18 inches. In one example, hull 102 has an OD of about 12 inches to fit within a standard torpedo tube of a US submarine.

Underwater vehicle 100 includes one or more fins 104 that extend away from hull 102 and are used to control movements of underwater vehicle 100 within the water. According to some embodiments described further herein, one or more fins 104 are part of a fin control device that is designed to extend and retract one or more fins 104. For example, the fin control device is capable of moving one or more fins 104 between a first position extended at their full length away from hull 102 and a second position where one or more fins 104 are brought closer inwards towards hull 102. When one or more fins 104 are in their second position, the effective OD of underwater vehicle 100 is reduced closer to that of the actual OD of hull 102. As used herein, the term "effective OD" refers to the actual OD of hull 102 plus any extension away from hull 102 created by one or more fins 104. One or more fins 104 may be located at a back end of underwater vehicle 100 (e.g., closer to a propulsion system of underwater vehicle 100), or anywhere else along hull 102. In some embodiments, one or more fins 104 may be organized in sets based on their location with multiple sets of fins 104 located along a length of hull 102. Furthermore, one or more fins 104 may be arranged anywhere around a circumference of hull 102. In the case of multiple fins around the circumference, the fins may be spaced evenly apart from one another.

Underwater vehicle 100 also includes a fin control system 106. Fin control system 106 includes any number of components, such as actuators, and other structures coupled to one or more fins 104 to control fine fin movement (e.g., tilt angle) and coarse fin movement (e.g., extending or retracting the one or more fins), according to some embodiments. For example, fin angle control 108 includes one or more servo actuators coupled to one or more fins 104 to control fine angle movements of one or more fins 104 while fin extender/retractor 110 includes one or more servo actuators and/or mechanical linkages designed to extend and retract one or more fins 104 to affect the effective OD of underwater vehicle 100. In some examples, fin control system 106 includes a specifically designed housing portion of hull 102 that facilitates the retraction/extension of one or more fins 104. For example, one or more fins 104 are folded into a recessed region (e.g., fin stowage volume 112) of the housing to reduce the effective OD of underwater vehicle 100. In another example, the housing includes a stationary outer housing and a rotatable inner housing that rotates to retract/extend the one or more fins coupled to the inner housing. The rotatable inner housing can rotate to draw one or more fins 104 back into a volume that is within hull 102 (e.g., fin stowage volume 112).

Figure 2:
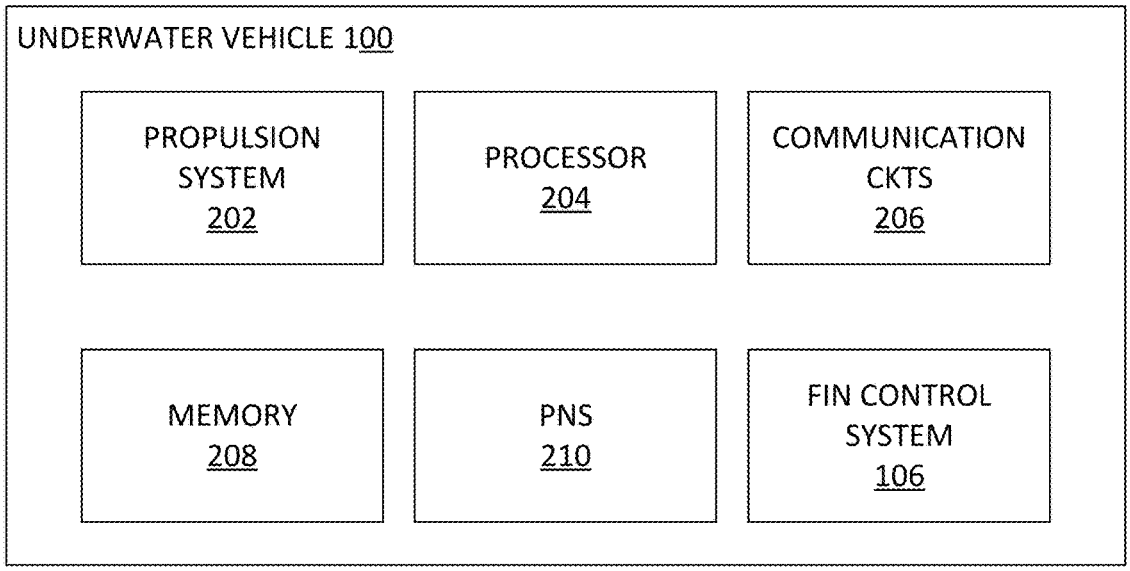
FIG. 2 illustrates select components of an underwater vehicle, in accordance with some embodiments of the present disclosure.

FIG. 2 illustrates some components of underwater vehicle 100, according to some embodiments. Underwater vehicle 100 may include a propulsion system 202, a processor 204, communication circuits 206, memory 208, a precision navigation system (PNS) 210, and fin control system 106.

Propulsion system 202 includes any number of elements involved in moving underwater vehicle 100 once it is submerged. Accordingly, propulsion system 202 may include a motor, a fuel source, and a propeller or jet nozzle. In some examples, the motor turns the propeller in the water to move underwater vehicle 100. In some other examples, the motor activates a pump that forces water out of the jet nozzle to move underwater vehicle 100. In another embodiment, the propulsion system is a passive, buoyancy-based mechanism as used in some types of undersea gliders.

Processor 204 represents one or more processing units that includes microcontrollers, microprocessors, application specific integrated circuits (ASICs), and field programmable gate arrays (FPGAs). According to some embodiments, processor 204 determines or otherwise directs all of the operations performed by underwater vehicle 100. In some such embodiments, processor 204 controls all operations performed by fin control system 106, as informed by the PNS 210.

Communication circuits 206 represents one or more communication devices such as RF and/or optical receivers, transmitters, or transceivers for sending/receiving wireless communication signals with, for example, a ship, aircraft, satellite, other underwater vehicle, or a land-based communication station. Data received by communication circuits 206 may include, for example, GPS signals to locate underwater vehicle 100, messages/communications, or signals to program a processing device onboard underwater vehicle 100. Data transmitted by communication circuits 206 may include, for example, messages/communications, or data gathered from any sensors onboard underwater vehicle 100.

Memory 208 represents one or more memory devices that can be any type of memory. The memory devices can be one or more of DDR-SDRAM, FLASH, or hard drives to name a few examples. Navigational routes or any other data may be preloaded into memory 208 before underwater vehicle 100 is submerged. In some embodiments, data received or collected from communication circuits 206 is stored in memory 208. In some embodiments, memory 208 stores control routines that are executable by processor 204, for controlling any of the components of fin control system 106.

PNS 210 may be included to provide additional data input for determining and/or refining the position of underwater vehicle 100. PNS 210 may include one or more inertial sensors that track movement of undersea vehicle 100. To this end, PNS 210 can provide navigation data to processor 204, which in turn can direct the fin control system 106 to navigate the UUV to a particular destination or location. As will be appreciated, note that processor 204 and PNS 210 can be part of an integrated control and navigation system, and their separate depiction is not intended to imply any rigid architecture.

As noted above, fin control system 106 includes one or more actuators to generate fine and/or course adjustments to the one or more fins. In some embodiments, for any given fin, one actuator is designed to provide fine adjustments to the angle of the fin while a different actuator is designed to provide coarse adjustments that retract or extend the fin into or away from hull 102. One or more of the actuators may be located on the outside of hull 102, and thus should be designed to withstand an aquatic environment (e.g., wet actuators). These wet actuators may include additional leak-proof sealing around any electrical components.

In some embodiments, fin control system 106 includes various mechanical linkages designed to facilitate rotation and/or translation of the one or more fins. The mechanical linkages may be coupled between any of the one or more actuators and any of the one or more fins. In the case of the rotatable inner housing, one or more mechanical linkages are used between a rotation actuator and the inner housing.

Fin control system 106 includes software routines and/or subroutines designed to provide control signals to the one or more actuators for moving the one or more fins, according to some embodiments. These routines and/or subroutines may be stored in memory 208 or within a memory component of fin control system 106. The routines and/or subroutines may be executed by processor 204 and/or by a processor component of fin control system 106.

Figure 3B:
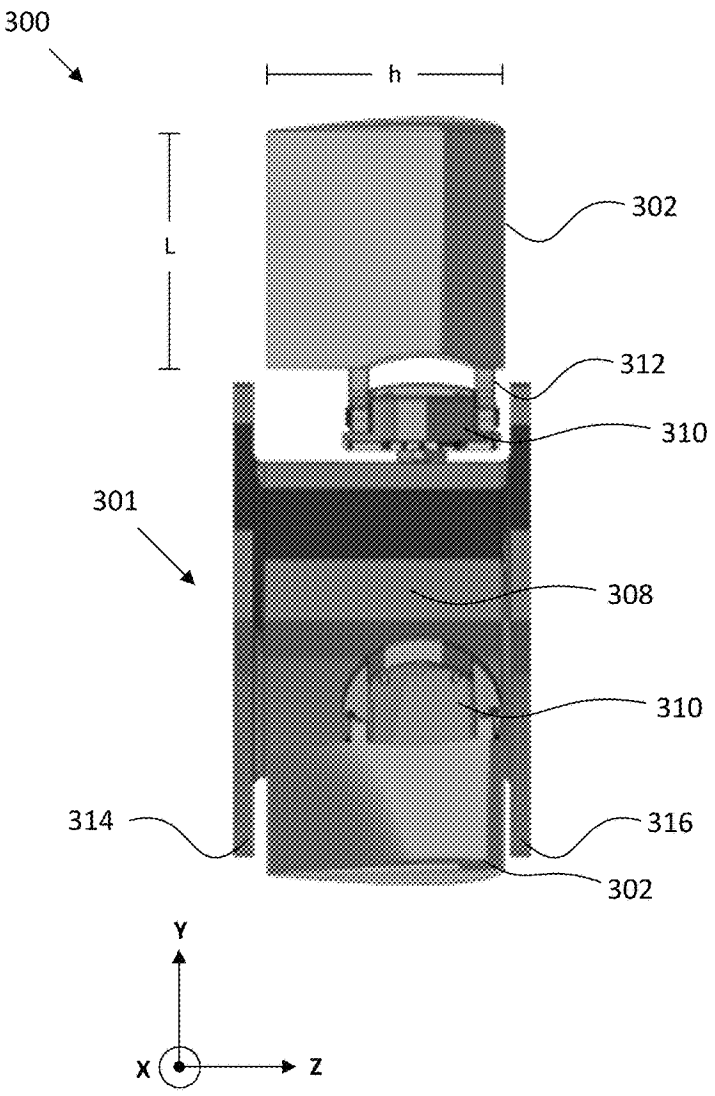
FIGS. 3A-3D illustrate cross section and side views of an underwater vehicle with fins extended and retracted, in accordance with some embodiments of the present disclosure.
Figure 3A:
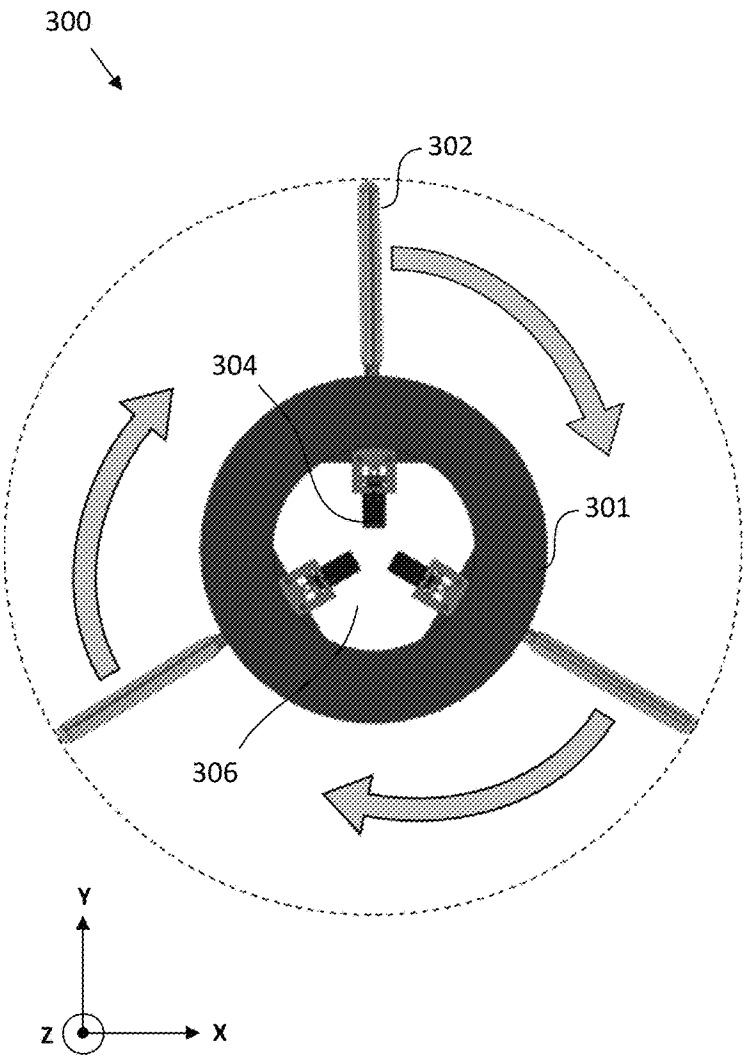
Figure 3D:
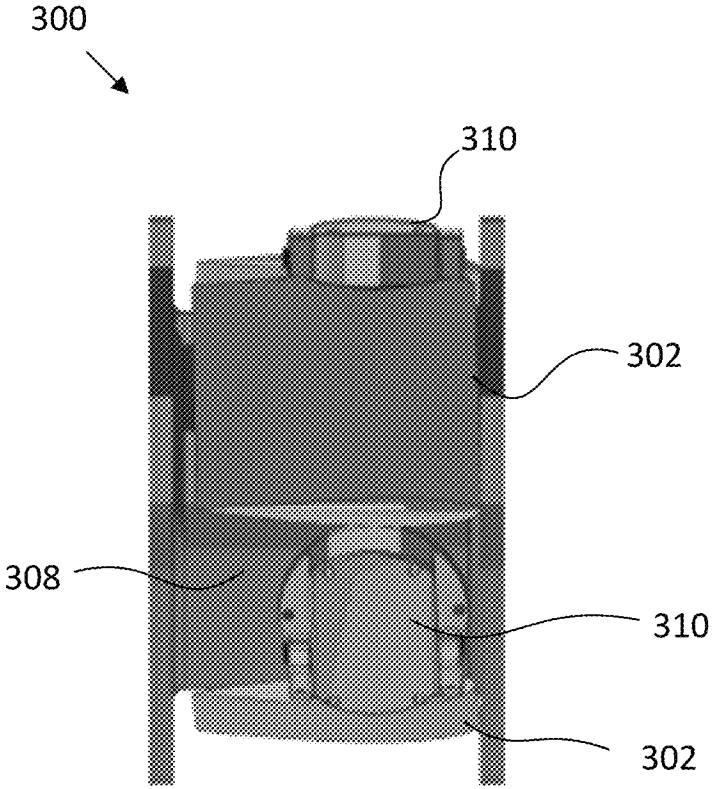
Figure 3C:
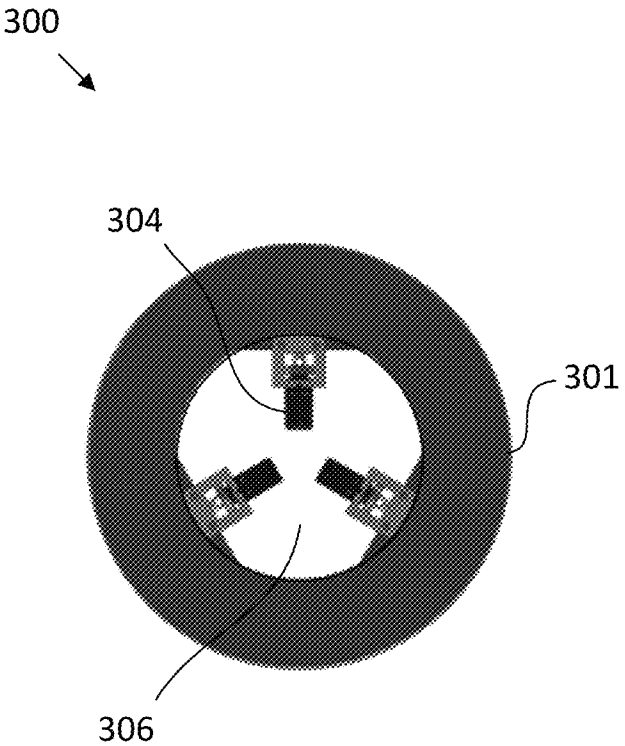
Figure 4A:
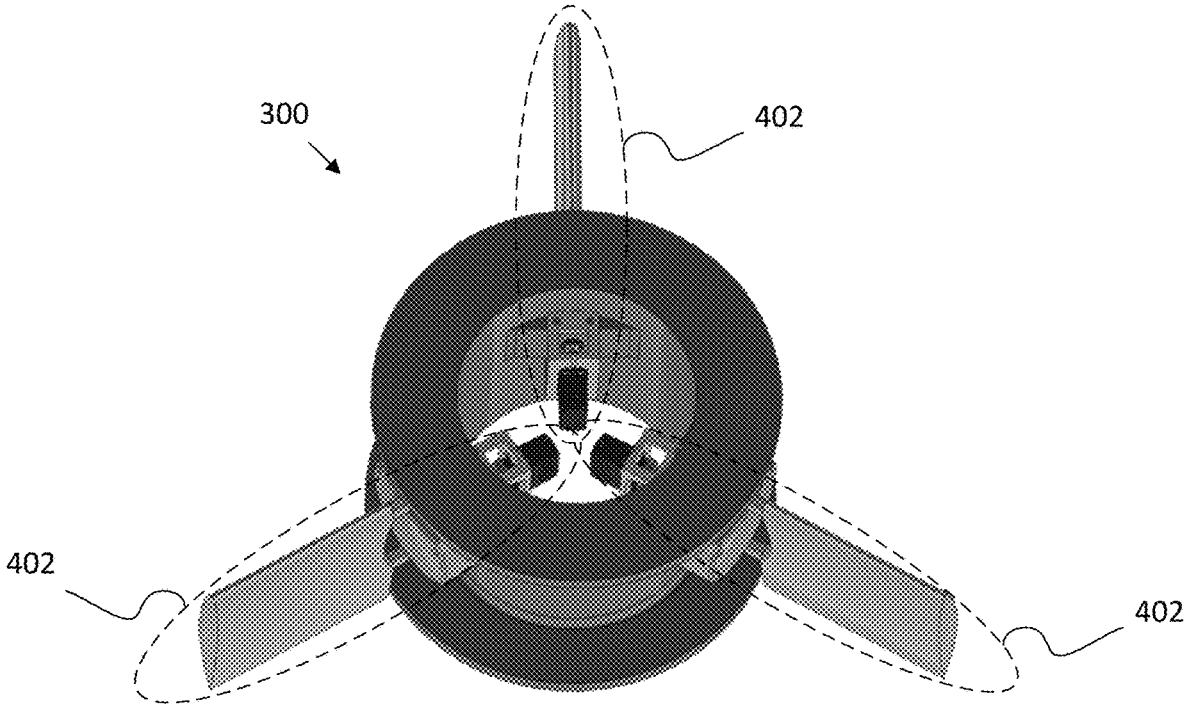
FIGS. 4A-4F illustrate the underwater vehicle of FIGS. 3A-3D with various positions of fins as they are retracted, in accordance with some embodiments of the present disclosure.
Figure 4B:
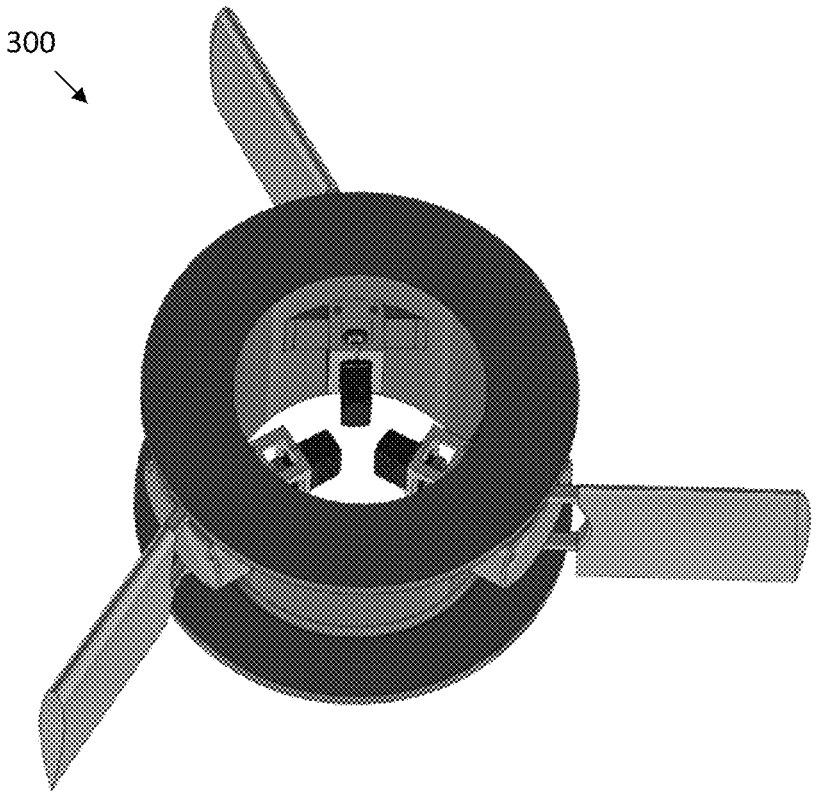
Figure 4C:
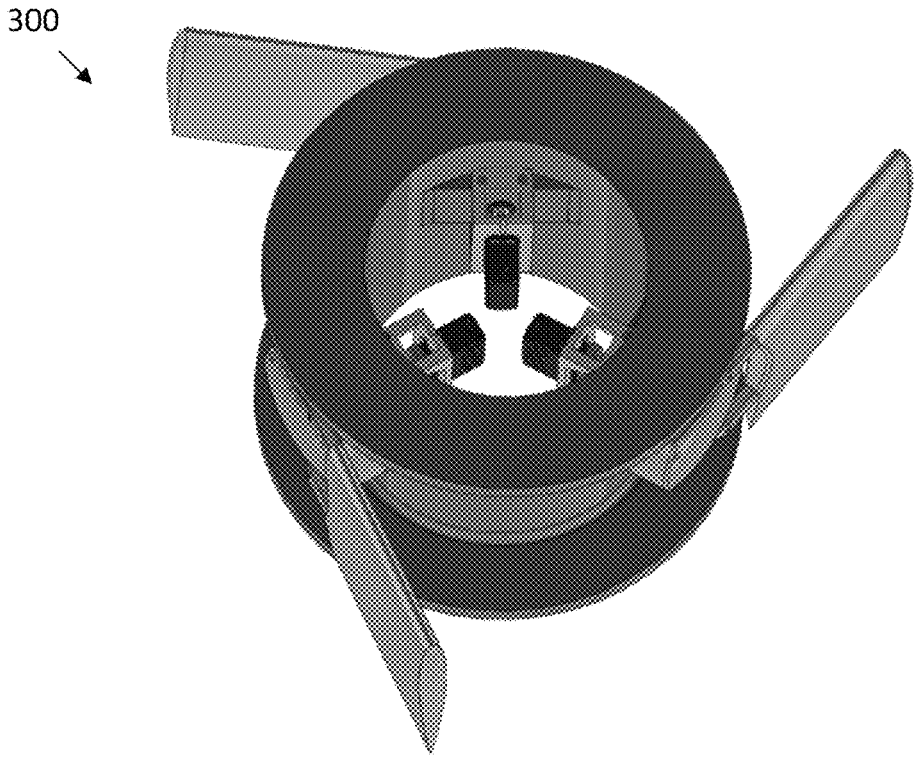
Figure 4D:
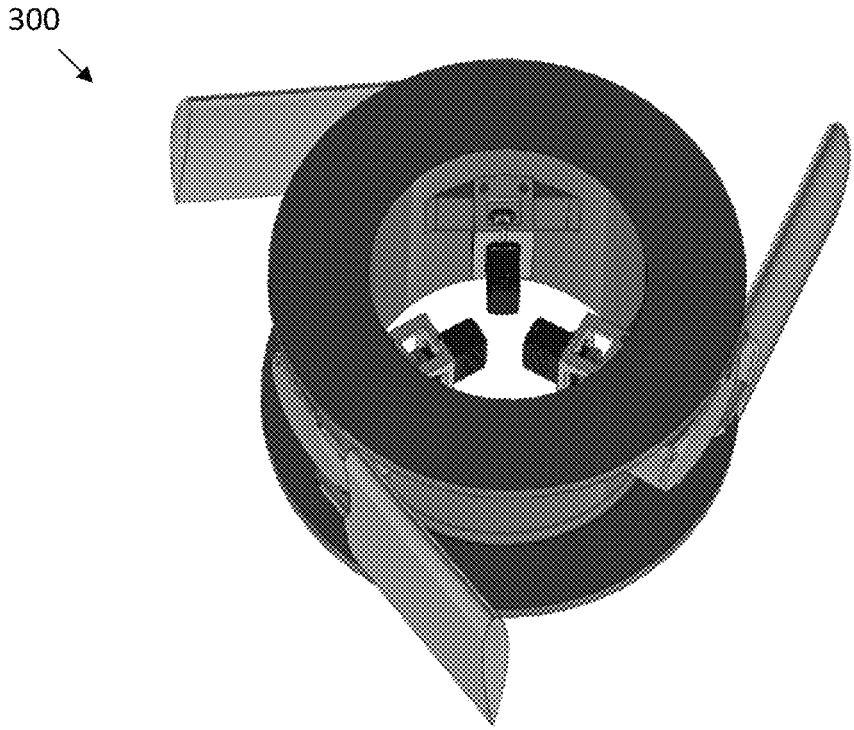
Figure 4E:
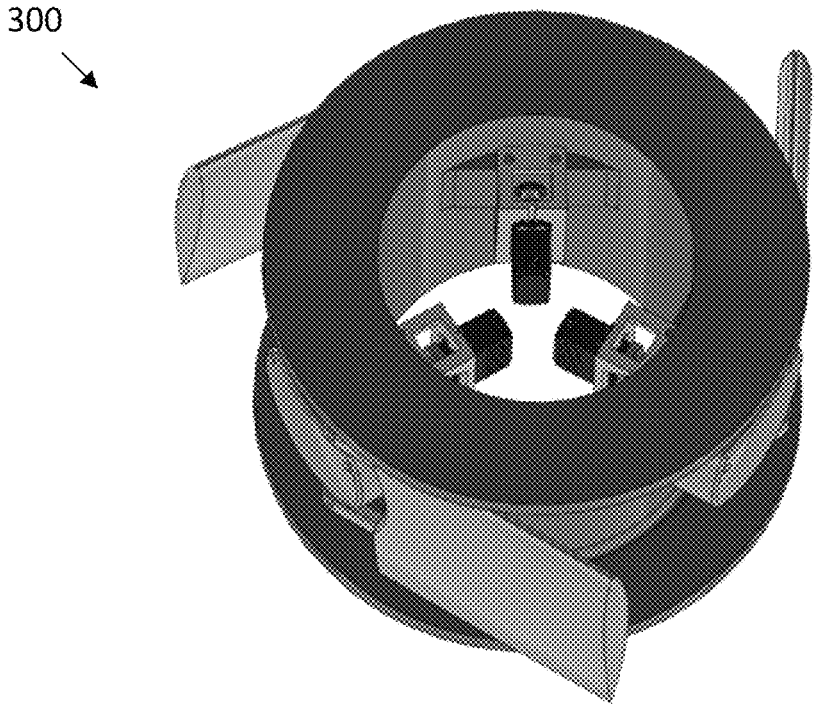
Figure 4F:
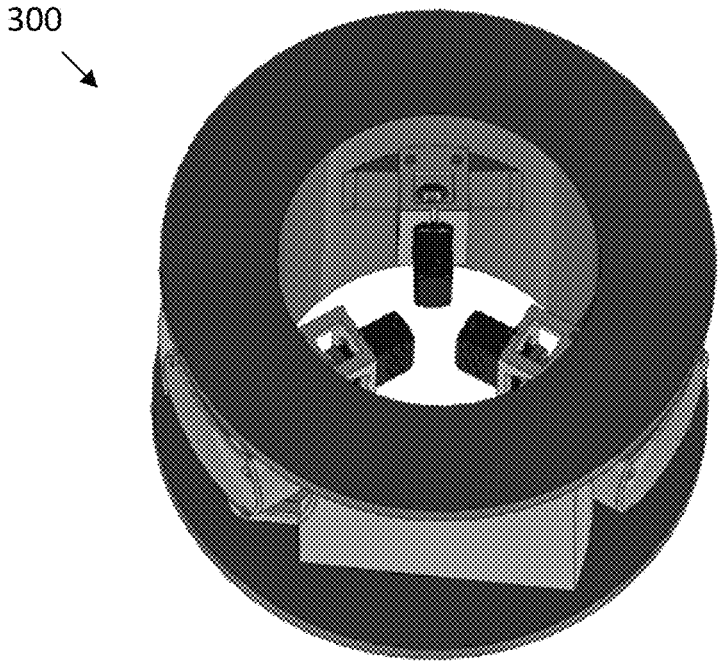

FIGS. 3A-3D illustrate cross-section and side views of a fin control system 300 that uses folding mechanisms to fold the fins 302 inwards towards a housing section 301, according to an embodiment. FIGS. 3A and 3B illustrate fin control system 300 with fully extended fins while FIGS. 3C and 3D illustrate fin control system 300 with fully retracted fins. Although three fins are illustrated in this example, any number of fins may be used as part of fin control system 300. Each fin 302 of fin control system 300 may be considered a component of or coupled to a separate fin control device that includes one or more actuators for the corresponding fin. In the illustrated example, three fin control devices are spaced such that there is equidistant spacing around housing section 301 between adjacent ones of the fin control devices. As seen between both FIGS. 3A and 3B, each fin control device includes a tilt actuator 304 and a fold actuator 310 operatively coupled to a corresponding one of the fins 302. Housing section 301 may be a part of hull 102 and includes a different structural design than the remainder of hull 102, according to an embodiment.

Each fin 302 may be formed by any number of suitable manufacturing processes, but in some example embodiments are formed via a 3D printing method to create an epoxy-filled polymer in the desired fin-shape. Other lightweight materials may be used for fins 302 such as aluminum or other plastics. A chord length (L) for any given fin 302 can vary from one embodiment to the next, but in some example cases is between about 4 inches and 8 inches. In one such example embodiment, the chord length (L) is about 6 inches. A height (h) for any given fin 302 can vary from one embodiment to the next, but in some example cases is between about 4 inches and 8 inches. In one such example embodiment, the height (h) is about 6 inches.

Each fin 302 is coupled to a tilt actuator 304 designed to control the angle of its associated fin 302, according to an embodiment. Tilt actuator 304 can be any known servo motor, such as a stepper motor or any other type of brushless motor. According to some embodiments, tilt actuator 304 is coupled to fin 302 through a wall 308 of housing section 301, such that tilt actuator 304 is located within an inner surface of wall 308. The inner surface of wall 308 may define a volume 306 within housing section 301. In some embodiments, tilt actuator 304 is arranged against the inner surface of wall 308.

Tilt actuator 304 is designed to provide fine and coarse movements to fin 302 that change its angle about one or more axis of rotation. For example, tilt actuator 304 may rotate fin 302 about the shaft axis (e.g., Y-axis in FIG. 3A). In some examples, tilt actuator 302 rotates fin 302 about the X axis, or about the Y axis and X axis simultaneously. In any such cases, the tilt actuators can work in unison and under the control of the fin control system 106.

Each fin 302 is also coupled to a corresponding fold actuator 310 via one or more linkages 312, according to an embodiment. Fold actuator 310 can also be any known servo motor, such as a stepper motor or any other type of brushless motor. In this example case, fold actuator 310 is coupled to an outer surface of wall 308 such that fold actuator 310 is exposed to water when the underwater vehicle is in use. Accordingly, fold actuator 310 may be designed as a wet servo with leakproof sealing measures taken to protect any electrical components. According to an embodiment, fold actuator 310 rotates fin 302 about the Z axis between a first position (deployed) extending from wall 308 and a second position (stowed) within an annular region between a first flange 314 and a second flange 316 around an outer surface of wall 308. Note that use of the terms "first" and "second" is not intended to imply that the fins have to start in either the first or second position; rather, first and second fin positions simply refer to stowed and deployed positions, respectively. The rotation may occur in either direction from the first position to the second position or from the second position to the first position. Flange 314, flange 316, and wall 308 are components of housing section 301 and form a spool shape, according to an embodiment. In some embodiments, flange 314 and flange 316 have an outer diameter that may be equal to the outer diameter of hull 102. Any number of fins may be folded into the annular region between flange 314 and flange 316 such that the fins either do not extend beyond the OD of hull 102 or the amount that the fins do extend beyond the OD of hull 102 is reduced from their fully extended state. According to some embodiments, the fins rest against wall 308 when they are folded into the second position. FIGS. 3A and 3B illustrate fins 302 in a first position fully extended from wall 308 while FIGS. 3C and 3D illustrate fins in a second position within the annular region between flange 314 and flange 316. The arrows in FIG. 3A generally illustrate the rotation direction of the various fins when being brought inwards towards wall 308. By maintaining the fins on the outside of wall 308 during their entire rotation, volume 306 up to the inner surface of wall 308 is maintained.

In some embodiments, fold actuator 310 is designed to rotate fin 302 and stop at any position between the first position and the second position. In some embodiments, fold actuator 310 is designed to rotate fin 302 between the second position against or adjacent wall 308 on one side of fold actuator 310 and a third position against or adjacent wall 308 on the opposite side of fold actuator 310.

For any given fin control device, tilt actuator 304 and fold actuator 310 may be independently controlled. Furthermore, the actuators of one fin control device may be actuated independently of the actuators of any other fin control devices on the same fin control system 300.

According to some embodiments, FIGS. 3A and 3B illustrate the extended position of fins 302 when underwater vehicle 100 is operating within the water while FIGS. 3C and 3D illustrate the folded position of fins 302 when underwater vehicle 100 is confined within a stowage/storage tube. The dashed circle in FIG. 3A illustrates the full vehicle diameter when fins 302 are extended in their first position. Once ejected from the stowage/storage tube, the fin control devices may be used to independently fold each of fins 302 into the extended position illustrated in FIGS. 3A and 3B.

FIGS. 4A-4F illustrate various stages of fin rotation between a first position (fully extended) and a second position (fully folded) using fin control system 300, according to some embodiments. Fin control system 300 includes one or more fin control devices 402, with each fin control device having a fin, a tilt actuator, and a rotation actuator. It should be noted that the rotational actuators are configured to rotate the fins in both directions (e.g., from first position to second position or from second position to first position). The progression from FIG. 4A to FIG. 4F illustrates snapshots over time when folding the fins inwards closer to the housing section.

Figure 5B:
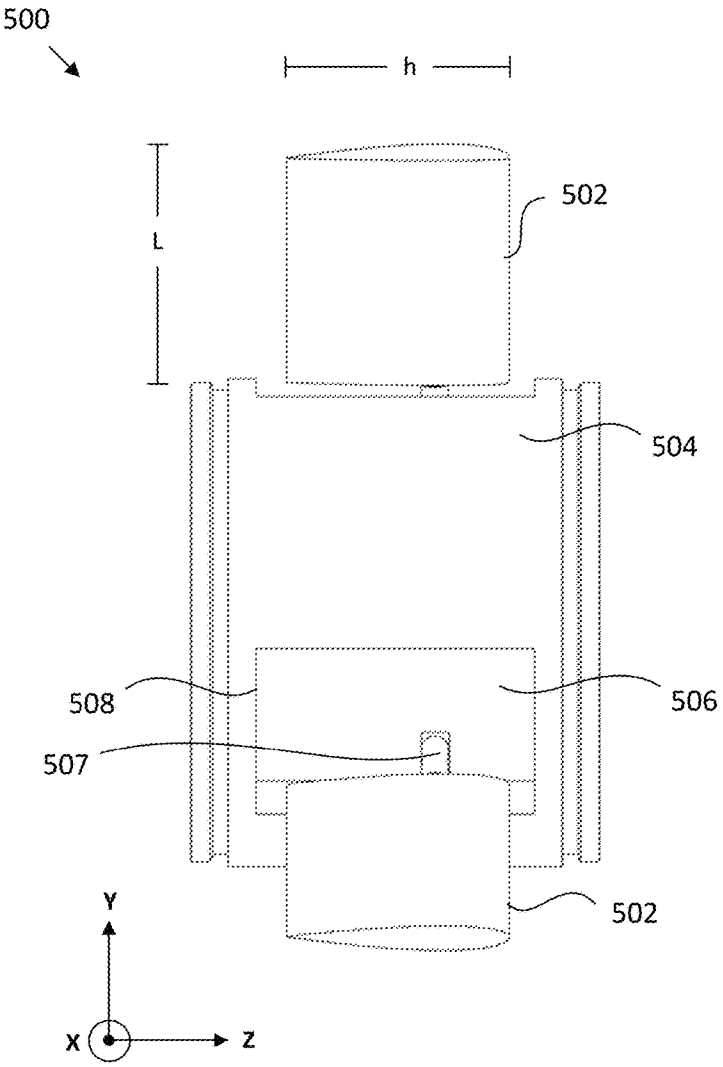
FIGS. 5A-5D illustrate cross section and side views of another underwater vehicle with fins extended and retracted, in accordance with some embodiments of the present disclosure.
Figure 5A:
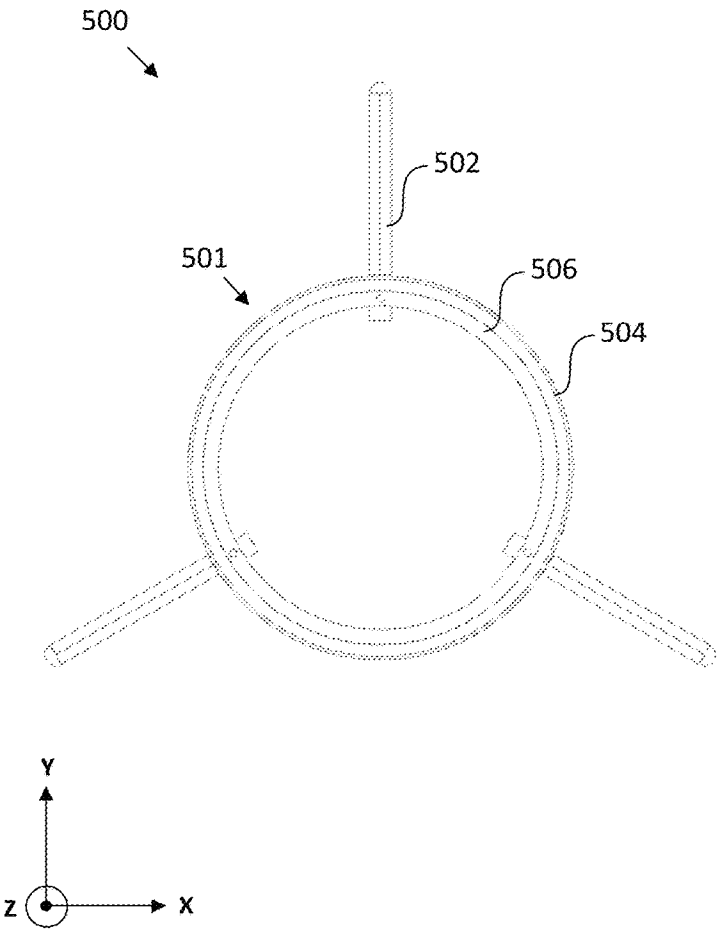
Figure 5D:
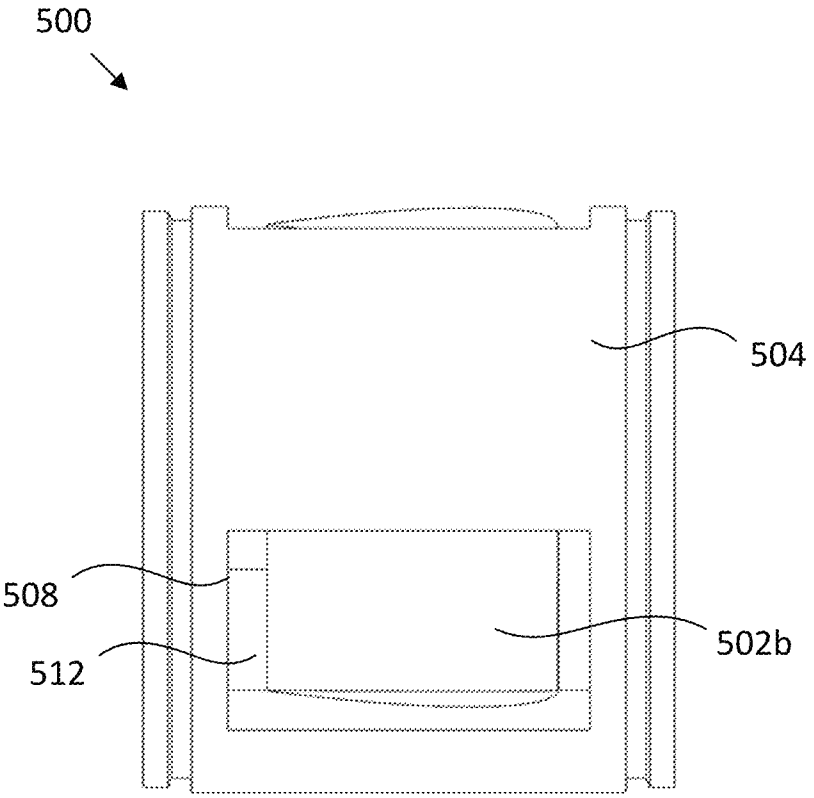
Figure 5C:
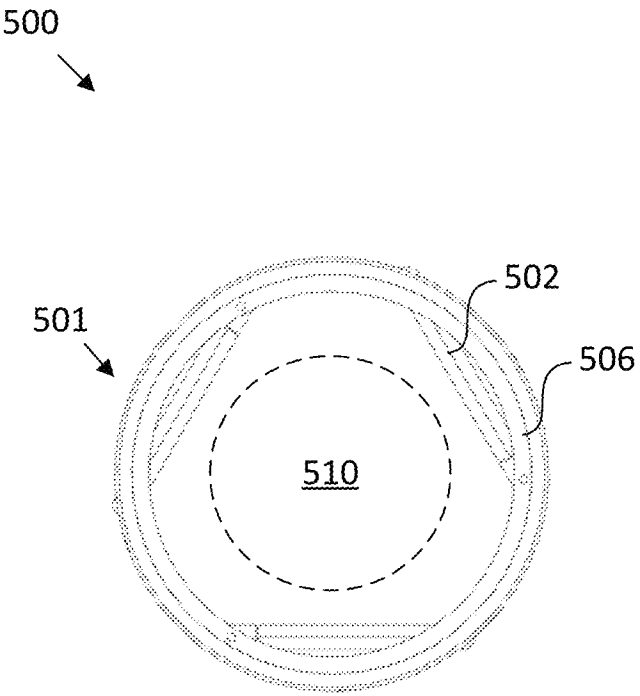

FIGS. 5A-5D illustrate cross-section and side views of another fin control system 500 that uses a rotating mechanism to slide the fins inwards and outwards, according to an embodiment. FIGS. 5A and 5B illustrate fin control system 500 with fully extended fins while FIGS. 5C and 5D illustrate views of fin control system 500 with fully retracted fins. Although three fins are illustrated in this example, any number of fins may be used as part of fin control system 500. Each fin 502 of fin control system 500 may be considered a component of or coupled to a fin control device that includes one or more actuators for providing fine and coarse movements of fins 502. In the illustrated example, three fins are spaced such that there is equidistant spacing between adjacent ones of the fins around housing section 501. As seen between both FIGS. 5A and 5B, housing section 501 includes two concentric sections—an outer housing 504 and an inner housing 506. Housing section 501 may be a part of hull 102 and includes a different structural design than the remainder of hull 102, according to an embodiment.

Each fin 502 may be formed, for example, via a 3D printing method to create an epoxy-filled polymer, as previously explained. The previous discussion with respect to fin materials and geometry is equally applicable here.

Each fin 502 is coupled to a corresponding tilt actuator designed to control a tilt angle of its associated fin 502, according to an embodiment. These tilt actuators may function in the same way as described above for tilt actuators 304 in order to provide fine and coarse movements to fin 502 that change its angle about one or more axis of rotation. Accordingly, the tilt actuator may be any known servo motor, such as a stepper motor or any other type of brushless motor. According to some embodiments, the tilt actuator is coupled to its corresponding fin 502 via a mechanical linkage 507 that extends within both outer housing 504 and inner housing 506. In some embodiments, one or more of the tilt actuators is coupled to an inner surface of inner housing 506. The tilt actuators may be independently controlled thus providing independent tilt angle control for each fin 502.

According to some embodiments, each fin 502 is also coupled to inner housing 506 via a pivoting sliding joint as can be seen more clearly in FIGS. 6A-6F. A rotation actuator is coupled to inner housing 506 and is configured to rotate inner housing 506 while outer housing 504 remains stationary, according to an embodiment. This rotation may be accompanied by a bushing design or ball bearings between inner housing 506 and outer housing 504. The rotation actuator may be a stepper motor or any other type of brushless motor. According to some embodiments, only one actuator is used to rotate inner housing 506. The rotation actuator may be located generally anywhere within the hull of the underwater vehicle. In some embodiments, a length (along the Z axis) of inner housing 506 rotates within only a portion of a length of outer housing 504 and the rotation actuator is located within outer housing 504 outside of where inner housing 506 is located. The arrows seen in FIG. 5A illustrate a direction of rotation of inner housing 506 compared to the stationary outer housing 504 that would cause fins 502 to be retracted from their first extended position into a second retracted position as illustrated in FIG. 5C. The dashed circle in FIG. 5A illustrates the full vehicle diameter when fins 502 are extended in their first position.

According to some embodiments, outer housing 504 includes an opening 508 through an entire thickness of outer housing 504. Outer housing 504 includes an opening 508 for each fin 502, such that fin 502 extends through a corresponding opening 508 when extended outward and away from outer housing 504, in a deployed position. In the example embodiment shown, opening 508 has a rectangular shape large enough to accept the size of fin 502 when fin 502 is retracted back into opening 508, to a stowed position. According to some embodiments, rotation of inner housing 506 causes fins 502 to retract back through opening 508 and also through an opening 512 as seen in FIG. 5D. Inner housing 506 includes an opening 512 for each fin 502, such that fin 502 retreats back through a corresponding opening 512 when pulled inwards as illustrated in both FIGS. 5C and 5D.

According to some embodiments, rotation of inner housing 506 changes the alignment between opening 508 and opening 512 as well as causes a rotational sliding movement of fin 502 to either extend or retract fin 502 through both opening 508 and opening 512. For example, rotation of inner housing 506 in a first direction can extend fins 502 radially outwards at a first position while misaligning opening 508 and opening 512 as illustrated in FIGS. 5A and 5B. Conversely, rotation of inner housing 506 in the opposite direction can retract fins 502 inwards to a second position while aligning opening 508 and opening 512 as illustrated in FIGS. 5C and 5D. In some embodiments, opening 508 and opening 512 are the same shape and size.

Due to the presence of openings 508 and 512, a volume exists within housing section 501 outside of an inner volume 510, according to an embodiment. Inner volume 510 may be greater compared to other retractable fin designs because all actuators for moving fins 502 are kept out of inner volume 510. Accordingly, each of the actuators (e.g., tilt actuators and rotation actuator) may be designed as wet servos with leakproof sealing measures taken to protect any electrical components.

FIGS. 6A-6F illustrate various stages of fin movement between a first position (fully extended) and a second position (fully retracted) via rotation of inner housing 506 using fin control system 500, according to some embodiments. It should be noted that the rotation actuator is configured to rotate housing 506 in both directions (e.g., clockwise and counter-clockwise). The progression from FIG. 6A to FIG. 6F illustrates snapshots over time when retracting the fins inwards through opening 508 and opening 512.

Figure 6A:
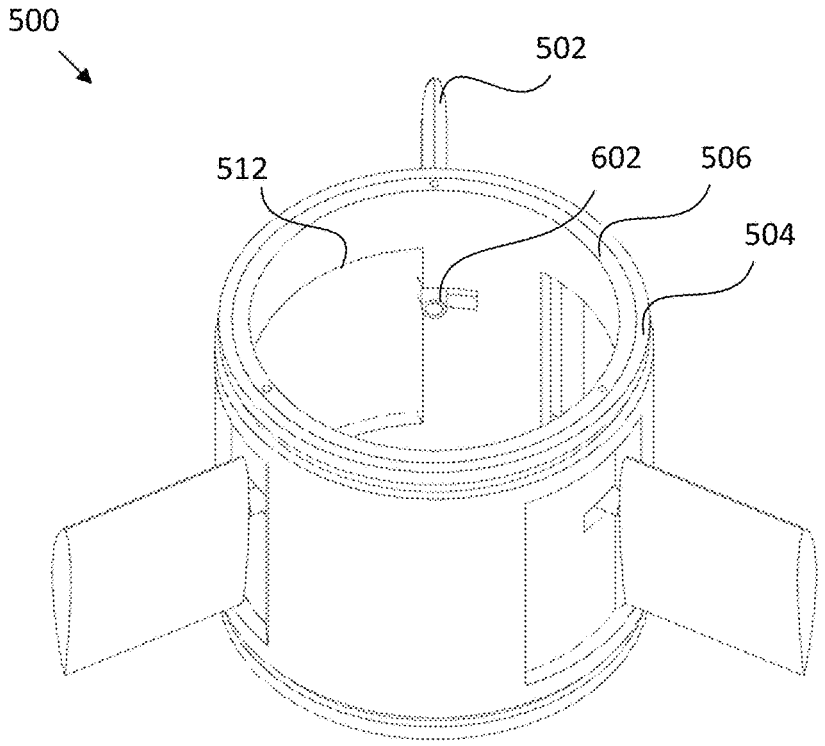
FIGS. 6A-6F illustrate the underwater vehicle of FIGS. 5A-5D with various positions of fins as they are retracted, in accordance with some embodiments of the present disclosure.

FIG. 6A illustrates each fin 502 in their fully extended first position. According to an embodiment, each fin 502 is coupled to inner housing 506 via a pivoting sliding joint 602. During rotation of inner housing 506, fin 502 is pulled inwards as it rotates about pivoting sliding joint 602 as progressively seen in FIGS. 6A-6F. Opening 512 is seen aligned with an inner wall of outer housing 504 when fins 502 are fully extended in their first position.

Figure 6B:
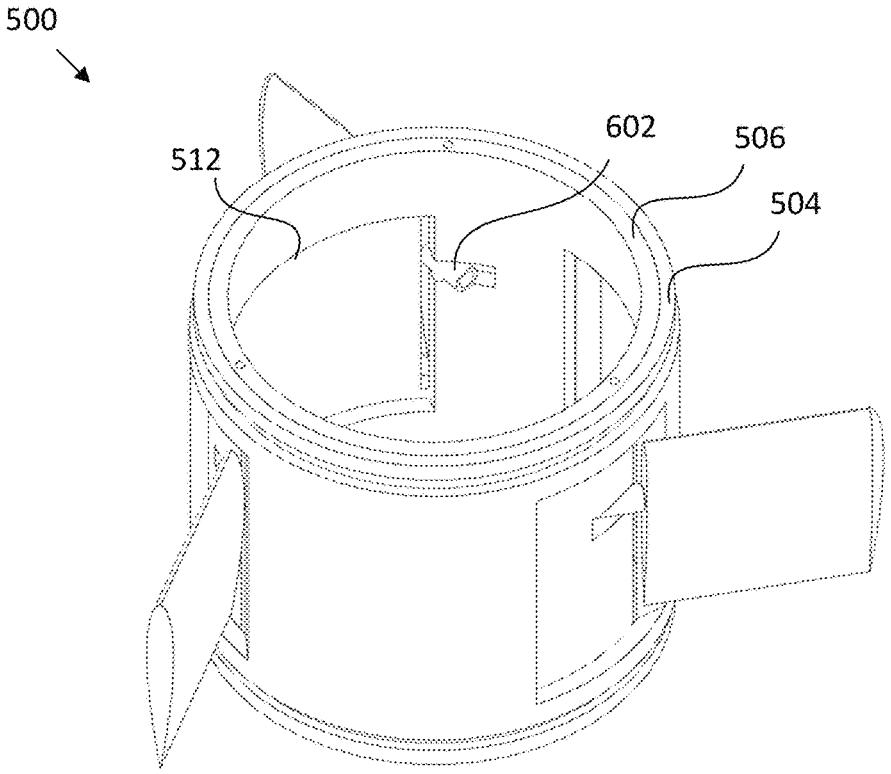
Figure 6C:
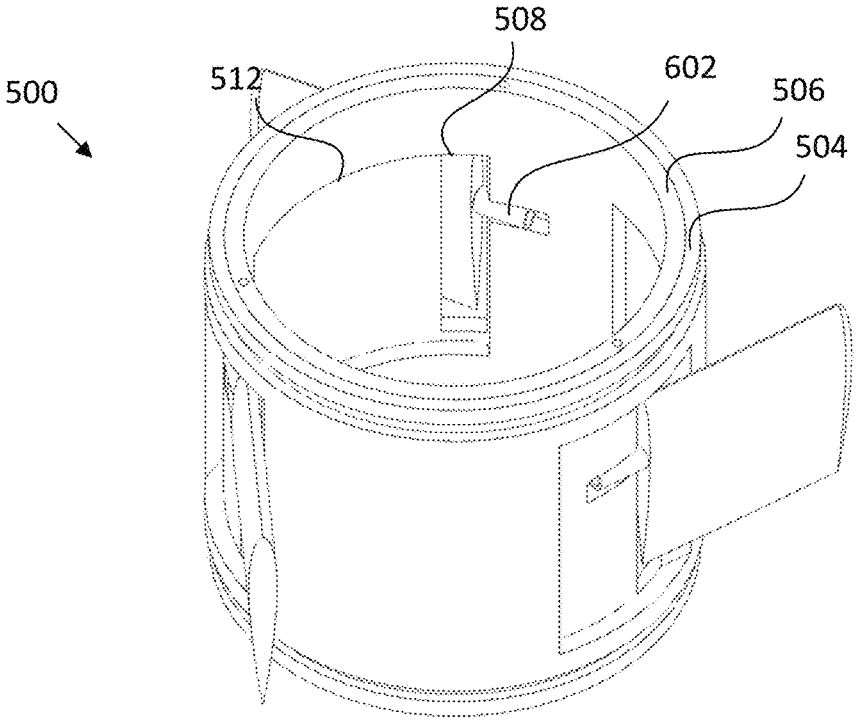
Figure 6D:
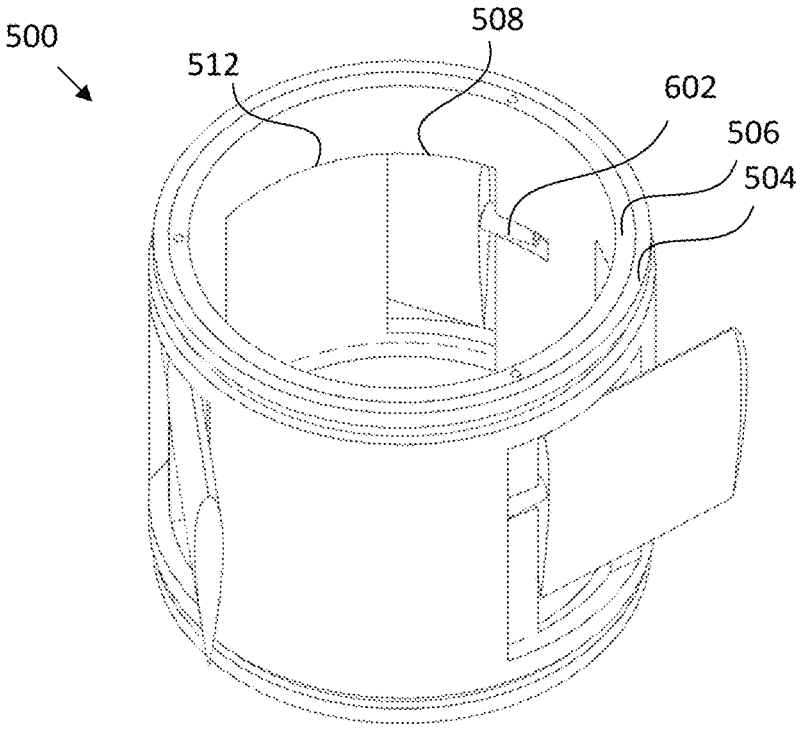
Figure 6E:
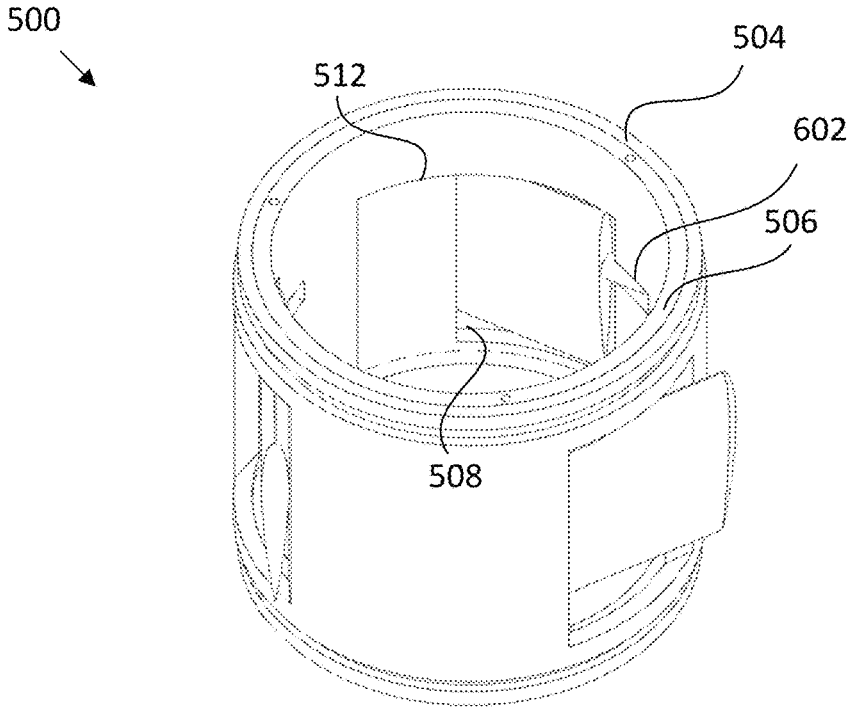
Figure 6F:
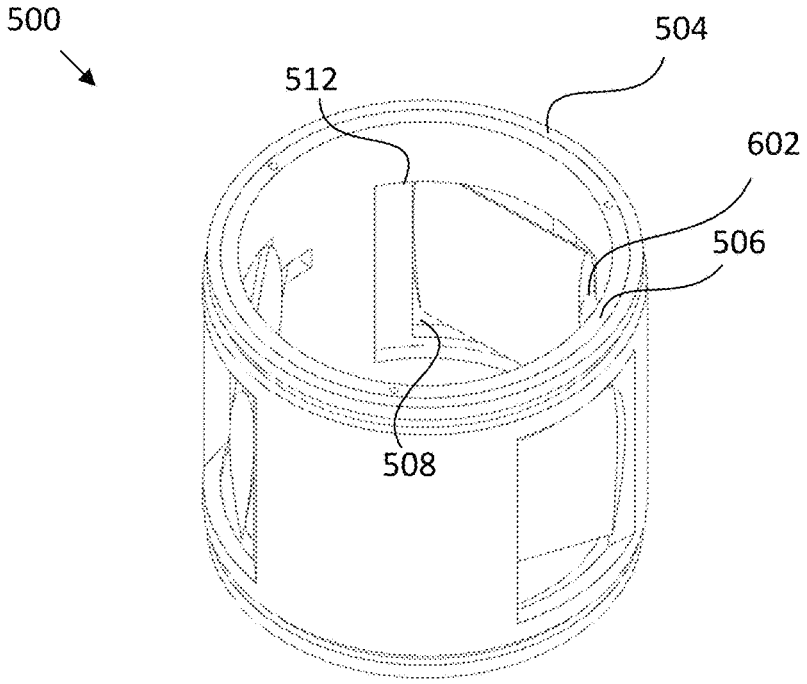

As can be seen beginning with FIG. 6B, as inner housing 506 is rotated, opening 512 rotates over opening 508, until both openings are aligned or nearly aligned in FIG. 6F. The rotation of inner housing 506 also rotates and pulls fins 502 into the ever-expanding opening 508 as opening 512 passes over opening 508. Ultimately, fins 502 are drawn inwards to a second position though both opening 512 and opening 508 as illustrated in FIG. 6F.

Figure 7:
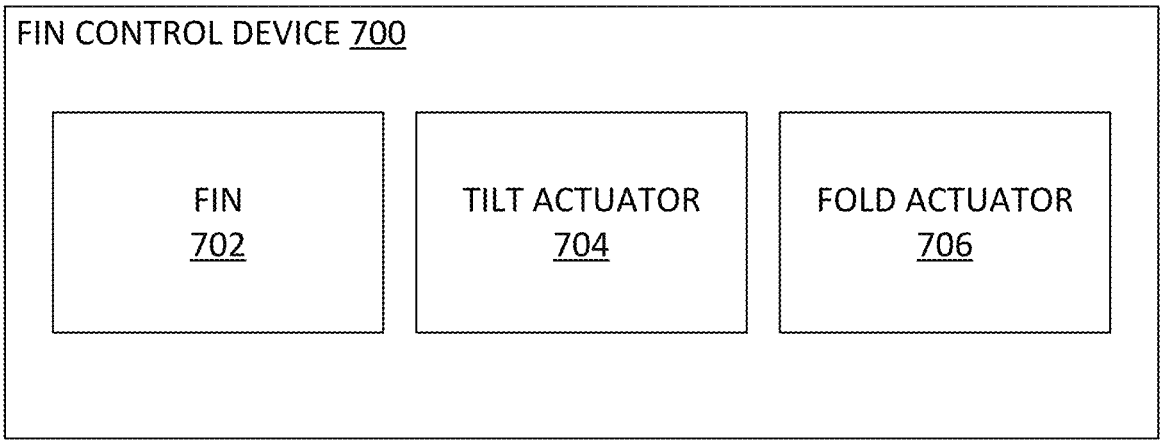
FIG. 7 illustrates select components of a fin control system for the underwater vehicle of FIGS. 3A-3D, in accordance with an embodiment of the present disclosure.

FIG. 7 illustrates an example fin control device 700, according to an embodiment. Fin control device 700 includes a fin 702, a tilt actuator 704, and a fold actuator 706. According to some embodiments, a fin control system includes any number of fin control devices 700 arranged around the circumference of a housing section of an underwater vehicle. In some embodiments, fin 702 is separate from fin control device 700 but is coupled to one or more components of fin control device 700. Tilt actuator 704 is designed to control a tilt angle of its associate fin 702, according to an embodiment. Tilt actuator 704 can by any know servo motor, such as a stepper motor or any other type of brushless motor. Fold actuator 706 may also be any known servo motor, such as a stepper motor or any other type of brushless motor. Fold actuator 706 is designed to rotate the fin between a first extended position and a second folded position that reduces the total diameter of the underwater vehicle. An example of fin control device 700 is illustrated as apart of in control system 300 in FIGS. 3A-3D and FIGS. 4A-4F.

Figure 8:
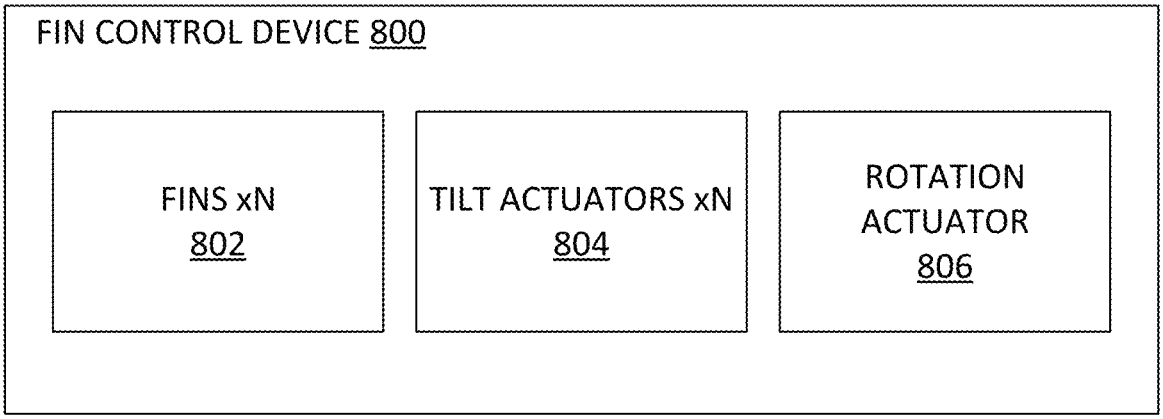
FIG. 8 illustrates select components of a fin control system for the underwater vehicle of FIGS. 5A-5D, in accordance with another embodiment of the present disclosure.

FIG. 8 illustrates an example fin control device 800, according to an embodiment. Fin control device 800 includes an N number of fins 802, an N number of tilt actuators 804, and a rotation actuator 806. According to some embodiments, a fin control system includes fin control device 800 having N fins 802 arranged around the circumference of a housing section of an underwater vehicle. In some embodiments, fins 802 are separate from fin control device 800 but are coupled to one or more components of fin control device 800. The value N may be any value from 1 to however many fins can be reasonably placed around the circumference of the housing section of the underwater vehicle. In the illustrated example of fin control system 500, N=3. Each tilt actuator of the N tilt actuators 804 is coupled to one fin of the N fins 802 and is designed to control a tilt angle of its associated fin 802, according to an embodiment. Each of the N tilt actuators 804 can be any known servo motor, such as a stepper motor or any other type of brushless motor. Rotation actuator 806 may also be any known servo motor, such as a stepper motor or any other type of brushless motor. Rotation actuator 806 is designed to rotate an inner housing coupled to each of the N fins 802 in order to move (via both a sliding and rotating motion) each of the N fins 802 between a first extended position and a second retracted position that reduces the total diameter of the underwater vehicle. An example of fin control device 800 is illustrated as a part of fin control system 500 in FIGS. 5A-5D and FIGS. 6A-6F.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Other embodiments may be implemented as software executed by a programmable control device. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

FURTHER EXAMPLE EMBODIMENTS

The following examples pertain to further embodiments, from which numerous permutations and configurations will be apparent.

Example 1 is a retractable fin control system that includes a housing section, a fin, and a fin control device. The housing section includes a first flange connected to a second flange by a cylindrical wall, the first flange and the second flange each having a larger diameter than the wall, such that an annular region exists around an outer surface of the wall and between the upper flange and the lower flange. The fin control device includes a first actuator and a second actuator. The first actuator is coupled to the fin and designed to rotate the fin between a stowed position within the annular region and a deployed position extending radially outward from the wall. The second actuator is designed to control a tilt angle of the fin.

Example 2 includes the subject matter of Example 1, wherein the fin control device is one fin control device of a plurality of fin control devices arranged around the wall of the housing section.

Example 3 includes the subject matter of Example 2, wherein each of the plurality of fin control devices is configured to operate independently of other fin control devices of the plurality of fin control devices.

Example 4 includes the subject matter of Example 2 or 3, wherein each of the plurality of fin control devices is arranged to have equidistant spacing around the wall between adjacent ones of the plurality of fin control devices.

Example 5 includes the subject matter of any one of Examples 1-4, wherein the first actuator comprises a stepper motor, and the second actuator comprises a stepper motor.

Example 6 includes the subject matter of any one of Examples 1-5, wherein an inner surface of the wall defines an inner volume, and the first actuator is fastened to the outer surface of the wall within the annular region, and the second actuator is disposed within the inner volume and fastened to the inner surface of the wall.

Example 7 includes the subject matter of any one of Examples 1-6, wherein a height of the fin is about half of an outer diameter of the first flange and the second flange.

Example 8 includes the subject matter of any one of Examples 1-7, wherein the first flange and the second flange have a same outer diameter.

Example 9 includes the subject matter of any one of Examples 1-8, wherein, in the stowed position, the fin rests against the outer surface of the wall.

Example 10 is an unmanned underwater vehicle (UUV) that includes the retractable fin control system of any one of Examples 1-9.

Example 11 is a retractable fin control system that includes a first cylindrical housing having a first diameter, a second cylindrical housing having a second diameter smaller than the first diameter, a fin coupled to the second cylindrical housing, and a fin control device. The second cylindrical housing is disposed within the first cylindrical housing and is designed to rotate within the first cylindrical housing. An inner surface of the second cylindrical housing defines an inner volume. The fin control device includes a first actuator and a second actuator. The first actuator is coupled to the second cylindrical housing and designed to rotate the second cylindrical housing between first and second positions, such that the fin extends radially outward from the first and second cylindrical housings to a deployed position when the second cylinder is in the first position, and the fin retracts inwards into the inner volume to a stowed position when the second cylinder is in the second position. The second actuator is coupled to the fin and designed to control a tilt angle of the fin.

Example 12 includes the subject matter of Example 11, wherein the fin is one fin of a plurality of fins, and the plurality of fins are arranged around the second cylindrical housing.

Example 13 includes the subject matter of Example 12, wherein a tilt angle of each fin of the plurality of fins is configured to be controlled independently from other fins of the plurality of fins.

Example 14 includes the subject matter of Example 12 or 13, wherein each of the plurality of fins is arranged to have equidistant spacing around the second cylindrical housing between adjacent ones of the plurality of fins.

Example 15 includes the subject matter of any one of Examples 11-14, wherein the first actuator comprises a stepper motor and the second actuator comprises a stepper motor.

Example 16 includes the subject matter of any one of Examples 11-15, wherein the second actuator is fastened to the inner surface of the second cylindrical housing.

Example 17 includes the subject matter of any one of Examples 11-16, wherein a height of the fin is about half of the first diameter.

Example 18 includes the subject matter of any one of Examples 11-17, wherein the second cylindrical housing comprises an opening and the fin is configured to pass through the opening when moving between the deployed position and the stowed position.

Example 19 includes the subject matter of any one of Examples 11-18, wherein the fin is coupled to the second cylindrical housing via a pivoting sliding joint.

Example 20 is an unmanned underwater vehicle (UUV) that includes the retractable fin control system of any one of Examples 11-19.

Numerous specific details have been set forth herein to provide a thorough understanding of the embodiments. It will be appreciated, however, that the embodiments may be practiced without these specific details. In other instances, well known operations, components and circuits have not been described in detail so as not to obscure the embodiments. It can be further appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

What is claimed is:

1. A retractable fin control system, comprising:

a housing section comprising a first flange connected to a second flange by a cylindrical wall, the first flange and the second flange each having a larger diameter than the wall, such that an annular region exists around an outer surface of the wall and between the first flange and the second flange;

a fin;

a fin control device, including a first actuator coupled to the fin and configured to rotate the fin between a stowed position within the annular region and a deployed position extending radially outward from the wall, and a second actuator configured to control a tilt angle of the fin; and wherein an inner surface of the wall defines an inner volume, and the first actuator is fastened to the outer surface of the wall within the annular region, and the second actuator is disposed within the inner volume and fastened to the inner surface of the wall.

2. The retractable fin control system of claim 1, wherein the fin control device is one fin control device of a plurality of fin control devices arranged around the wall of the housing section.

3. The retractable fin control system of claim 2, wherein each of the plurality of fin control devices is configured to operate independently of other fin control devices of the plurality of fin control devices.

4. The retractable fin control system of claim 2, wherein each of the plurality of fin control devices is arranged to have equidistant spacing around the wall between adjacent ones of the plurality of fin control devices.

5. The retractable fin control system of claim 1, wherein the first actuator comprises a stepper motor, and the second actuator comprises a stepper motor.

6. The retractable fin control system of claim 1, wherein a height of the fin is about half of an outer diameter of the first flange and the second flange.

7. The retractable fin control system of claim 1, wherein the first flange and the second flange have a same outer diameter.

8. The retractable fin control system of claim 1, wherein, in the stowed position, the fin rests against the outer surface of the wall.

9. An unmanned underwater vehicle (UUV) comprising the retractable fin control system of claim 1.

* * * * *